US005234059A

United States Patent [19]

Eynon

[11] Patent Number: 5,234,059

[45] Date of Patent: Aug. 10, 1993

[54] FRANGIBLE BULB SPRINKLER HEAD

[75] Inventor: Lawrence R. Eynon, Pewaukee, Wis.

[73] Assignee: Star Sprinkler Corporation, Milwaukee, Wis.

[21] Appl. No.: 857,783

[22] Filed: Mar. 26, 1992

[51] Int. Cl.[5] ..... A62C 37/08; A62C 37/10; A62C 37/11; A62C 37/14

[52] U.S. Cl. ..... 169/39; 137/72; 137/79; 169/37; 169/40

[58] Field of Search ..... 169/37, 38, 39, 40, 169/41, 90, 51; 137/72, 79

[56] References Cited

U.S. PATENT DOCUMENTS

| | | | |
|---|---|---|---|
| 2,125,510 | 8/1938 | Lewis | 169/38 |
| 3,727,695 | 4/1973 | Danton | 169/37 |
| 4,015,665 | 4/1977 | Simons et al. . | |
| 4,105,076 | 8/1978 | Simons et al. . | |
| 4,926,946 | 5/1990 | Polan | 169/37 |
| 4,930,578 | 6/1990 | Barnett et al. | 169/37 X |
| 4,976,320 | 12/1990 | Polan | 169/37 X |
| 4,977,963 | 12/1990 | Simons . | |
| 5,072,792 | 12/1991 | Simons et al. . | |
| 5,083,616 | 1/1992 | Polan | 169/37 X |

FOREIGN PATENT DOCUMENTS

| | | | |
|---|---|---|---|
| 648027 | 9/1962 | Canada | 169/38 |
| 339788 | 11/1989 | European Pat. Off. | 169/39 |
| 1065276 | 9/1959 | Fed. Rep. of Germany | 169/38 |
| 343806 | 2/1931 | United Kingdom | 169/38 |
| 516902 | 1/1940 | United Kingdom | 169/38 |
| 1359857 | 7/1974 | United Kingdom | 169/38 |

*Primary Examiner*—David M. Mitchell
*Assistant Examiner*—James M. Kannofsky
*Attorney, Agent, or Firm*—Andrus, Sceales, Starke & Sawall

[57] ABSTRACT

A quick response frangible bulb sprinkler head includes a tubular body connected to a water line. The body has an outlet that is enclosed by a cap or closure, which is held in the closed position by a lever assembly. The lever assembly includes a pair of lever arms which are disposed in an X-configuration, with one end of each arm engaged with the body and the opposite ends of the lever arms are spaced apart and engaged with the opposite ends of an elongated glass bulb. The axis of the bulb is disposed normal to the axis of the outlet in the body. A screw is threaded in the closure and the tip is engaged with a channel-shaped pressure member that is connected to the central portions of the lever arms. Through adjustment of the screw, the compressive force on the bulb can be varied.

20 Claims, 2 Drawing Sheets

FIG. 1
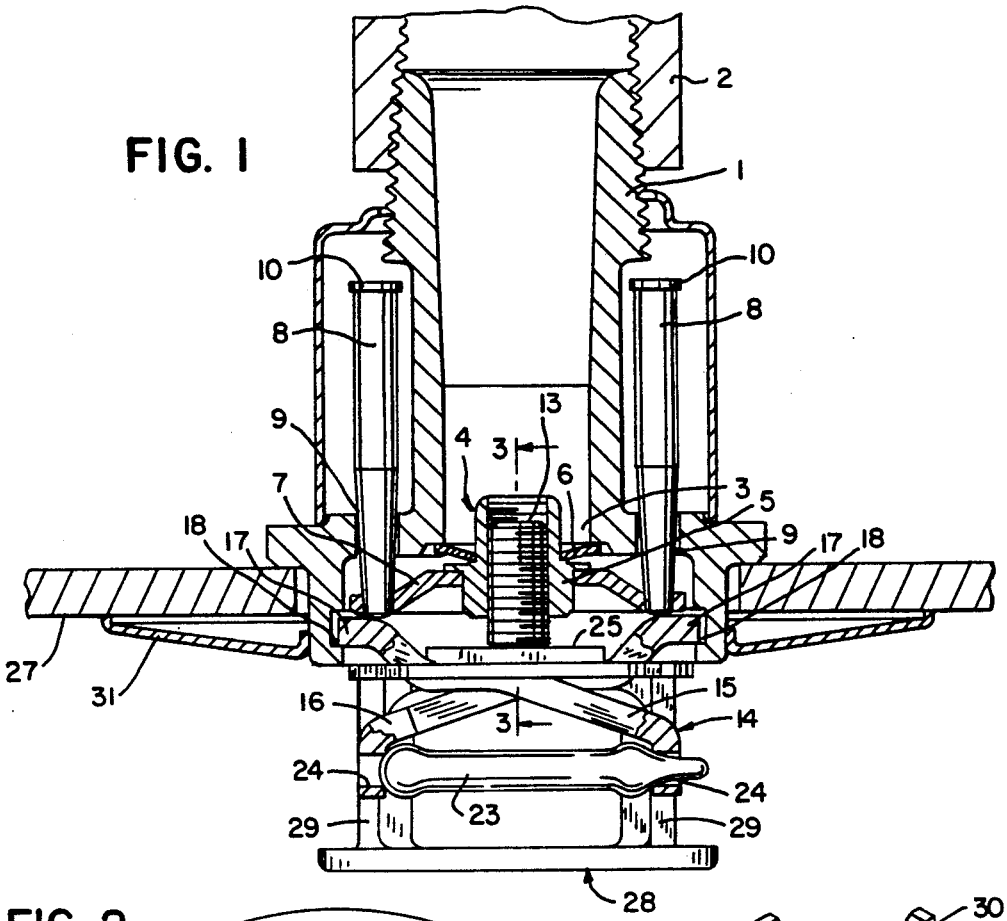
FIG. 2
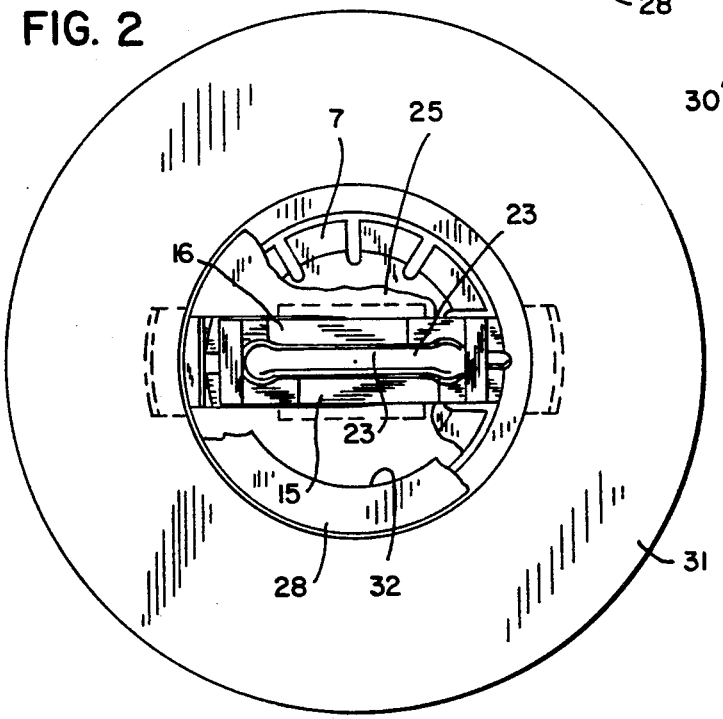
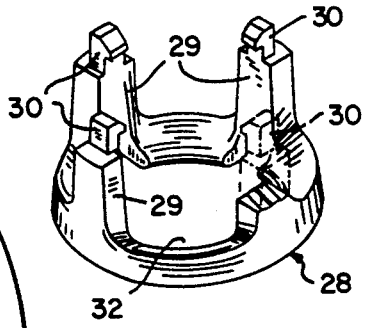
FIG. 6

FIG. 3
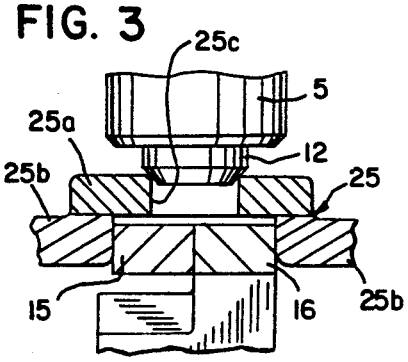
FIG. 4
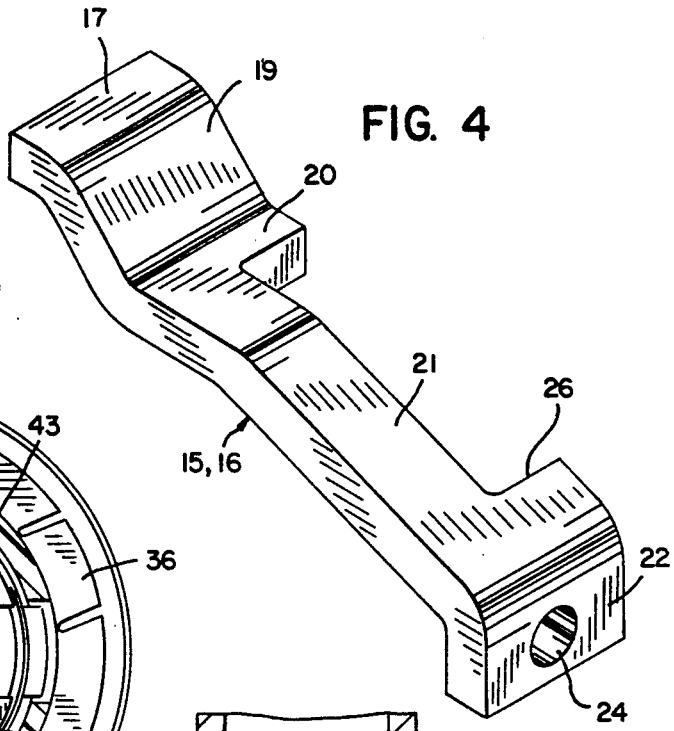
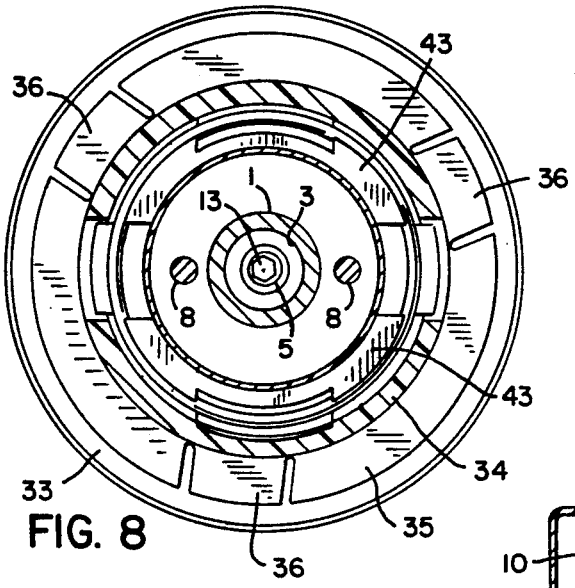
FIG. 8
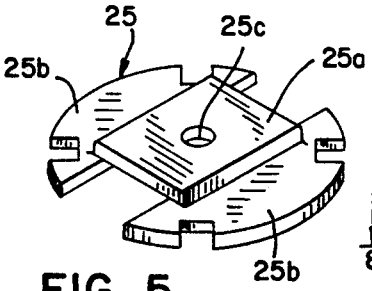
FIG. 5
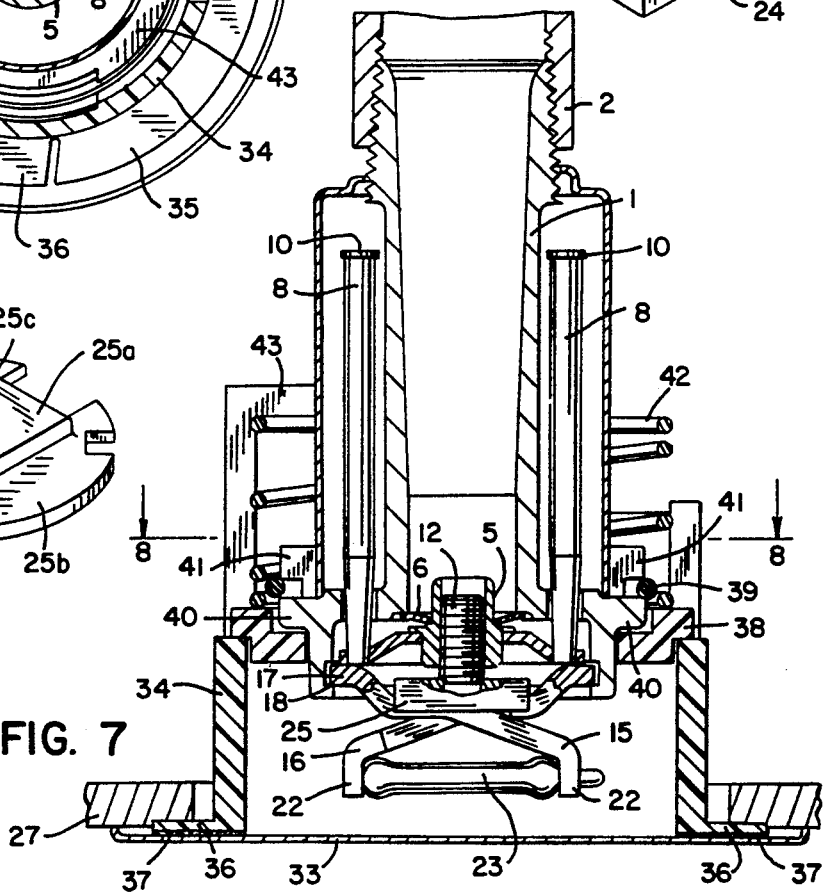
FIG. 7

FRANGIBLE BULB SPRINKLER HEAD

BACKGROUND OF THE INVENTION

The conventional sprinkler head includes a tubular body that is connected to a water line and defines a water outlet. A pair of support arms extend outwardly from the body and are joined together at a junction. A water deflector is then joined at the junction either permanently or on sliding rods. A cap or closure encloses the outlet in the body and a thermally responsive release mechanism interconnects the cap and the junction. One common form of thermally responsive release mechanism is a frangible glass bulb. The glass bulb provides a direct and stable release mechanism that generally requires fewer parts and less complicated assemblies than sprinklers with other forms of thermally responsive release mechanisms. With a sprinkler head incorporating a glass bulb, the bulb will fracture when exposed to a predetermined elevated temperature, thereby enabling the water pressure in the water line to release the cap. The water will then be directed from the outlet in the body against a deflector and deflected or spread in the desired pattern.

A sprinkler head as used in residential dwellings should have a quick response, meaning that it should release quickly for the objective of a residential sprinkler head is to save lives, as well as property protection. The response time of a residential sprinkler is measured in seconds and the reduction in response time of just a few seconds greatly improves the ability to control and subdue a residential fire in the initial stage, with its life threatening elements of heat, smoke, and noxious fumes.

In a typical glass bulb sprinkler head, the elongated bulb extends vertically or perpendicular to the ceiling. In a concealed mode, working components of the sprinkler head are positioned above the ceiling, with the glass bulb situated above the support arms and deflector, so that the lower end of the glass bulb may be up to one inch above the ceiling. During a fire, smoke and gases of combustion will rise and flow along the ceiling so that the area directly beneath the ceiling is at the highest temperature. Because the glass bulb of the typical concealed sprinkler head is mounted vertically, with the lower end of the bulb located a distance above the ceiling, the response of the typical concealed glass bulb sprinkler head is relatively slow.

A residential sprinkler should also be as inconspicuous, or as aesthetically appealing as possible. Two types of sprinklers have been developed by the fire protection industry in an effort to satisfy these requirements. The concealed sprinkler type, mounted above the ceiling, and the flush type, mounted even with the ceiling, with only the thermally responsive release mechanism extending down from the ceiling. At present there is no approved residential flush-type, glass bulb sprinkler.

SUMMARY OF THE INVENTION

The invention is directed to an improved quick response glass bulb sprinkler head that can be used either in a concealed or flush mode.

The sprinkler head includes a tubular body which is threaded to the water line and has an outlet that is enclosed by a cap or closure. The cap is held in the closed position by a lever assembly that includes a pair of lever arms which are disposed in an X-shape. One end of each lever arm is engaged with an internal shoulder on the body, and the opposite ends of the lever arms are spaced apart and are engaged with opposed ends of an elongated glass bulb. With this arrangement, the axis of the elongated bulb is parallel to the ceiling or other wall on which the sprinkler head is mounted, or in other words, the axis of the glass bulb is disposed normal to the axis of the outlet in the body.

A screw is threaded in the cap and the outer tip of the screw is engaged with a channel-shaped pressure member which straddles the center portions of the lever arms. Through threaded adjustment of the screw, the outer ends of the lever arms can be moved in a direction toward each other to increase the compressive force on the glass bulb.

In the concealed mode, the glass bulb is located slightly above the ceiling in the building and a decorative plate is attached to the body and conceals the bulb. The decorative plate is connected to the body by a low melting point alloy or solder.

When the sprinkler head is exposed to an elevated temperature, the solder will melt causing the decorative plate to fall away, thereby exposing the glass bulb to the combustion gases. At a given elevated temperature, the glass bulb will fracture, enabling the lever arms to release from the body. With the lever arms released, the pressure of the water in the body will dislodge the cap. The outer peripheral portion of the cap defines a deflector and the deflector will fall to a predetermined position where it is held by stops and the exiting water will then strike the deflector and be spread or deflected outwardly in the desired pattern.

With the concealed sprinkler head of the invention, the glass bulb, being situated at the lowest point of the sprinkler head, can be mounted directly above the decorative plate, adjacent the ceiling and in close proximity to the flow of high temperature gas, thereby providing the sprinkler head with a faster response time than sprinkler heads utilizing a vertically mounted glass bulb.

With a flush mounted arrangement, the glass bulb is mounted beneath the ceiling and a decorative protective housing or closure, having four legs with a latch canted inward on each end which snap into four corresponding notches of the channel-shaped pressure member, engages the ceiling and encloses the bulb. The housing is provided with a plurality of openings through which the combustion gases or heated air can flow. When the bulb is exposed to a predetermined elevated temperature, the bulb will fracture, releasing the lever arms and the cap in the same manner previously described.

As the glass bulb is mounted parallel to the ceiling or other supporting wall, the flush mounted sprinkler head protrudes a lesser distance into the room, thereby providing a more attractive appearance.

As a further advantage, the sprinkler head utilizes fewer parts than the conventional fusible alloy, flush mounted sprinkler head. In addition, the lever arms which engage the opposed ends of the glass bulb are of identical construction, thereby reducing the inventory of parts.

Further the same sprinkler head can be used in both concealed and flush mounted arrangements and this is a distinct advantage, because typical sprinkler heads cannot be interchanged for both concealed and flush mounting.

As a further advantage of the sprinkler head of the invention, the spring load plus the water pressure of the system exerts a force through the cap, screw and pressure member, dividing into two points on the lever arms, thereby transmitting a greater force to the shorter, fulcrum end of the lever arm, which is fixed under the inner lip of the sprinkler body, and a lesser force to the longer end of the lever arm engaging the glass bulb.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of the sprinkler head of the invention shown in a flush mount arrangement;

FIG. 2 is a bottom view of the sprinkler head with parts broken away;

FIG. 3 is a section taken along line 3—3 of FIG. 1;

FIG. 4 is a perspective view of one of the lever arms;

FIG. 5 is a perspective view of the pressure member;

FIG. 6 is a perspective view of the cover;

FIG. 7 is a view similar to FIG. 1 showing the sprinkler head in a concealed mode; and FIG. 8 is a section taken along line 8—8 of FIG. 7.

DESCRIPTION OF THE ILLUSTRATED EMBODIMENT

The drawings illustrate a quick response sprinkler head which includes a tubular metal body 1 which is threaded to a water line 2. Body 1 has a central longitudinal opening, terminating in an outlet 3, which is enclosed by a cap assembly or closure 4.

Cap assembly 4 includes a seal button 5 and a conical-shaped, plastic coated Belleville spring or resilient washer 6 is mounted on button 5 and bears against the end of body 1 to provide a seal for the outlet 3 and spring tension for the release mechanism.

Cap assembly 4 also includes a deflector 7 that extends radially outward from seal button 5 and a pair of guide rods 8 are secured within openings in opposed portions of the deflector 7. Rods 8 are slidable within openings 9 in body 1, and the upper ends of rods 8 are formed with enlarged ends or stops 10. When cap assembly 4 is released, the water pressure and the spring tension of Belleville washer 6, will dislodge the cap assembly, moving the cap assembly downward and stops 10 will engage body 1 to maintain the deflector 7 in a predetermined position beneath outlet 3. The water being discharged from the outlet 3 will engage the deflector 7 and be deflected or sprayed outwardly in the desired pattern.

Seal button 5 is provided with a threaded axial opening 11 and a screw 12 is threaded in the opening. The inner end of the screw 12 is provided with a hex-shaped hole or recess 13, which is adapted to be engaged by a suitable tool to thread the screw in the bushing.

Cap assembly 4 is maintained in the closed position by a releasable lever assembly 14 that is composed of a pair of lever arms 15 and 16. Lever arms 15 and 16 are identical in construction and are disposed in an X-configuration as shown in FIG. 1. The upper end 17 of each lever arm 15, 16 is engaged with an internal shoulder 18 on body 1, while an inclined section 19 extends downwardly from each end 17 and merges into a horizontal section 20. Extending downwardly from each horizontal section 20 is an inclined section 21 which terminates in a vertical end section 22, as best seen in FIG. 4.

A standard frangible glass bulb 23 of the type typically used in sprinkler heads interconnects the spaced portions or end sections 22 of the lever arms, 15, 16. Each end section 22 is formed with a hole or recess 24 and the respective ends of bulb 23 are received within the holes.

To apply compressive force to bulb 23, a channel-shaped pressure member 25 straddles the horizontal sections 20 of lever arms 15 and 16, as shown in FIG. 1. As shown in FIG. 5, pressure member 25 includes a central section or web 25*a* and a pair of generally semicircular side sections or flanges 25*b* which are spaced apart, defining a channel to receive the lever arms 15 and 16, as seen in FIG. 3. The upper surface of channel 25 is formed with an opening or pocket 25*c*, which receives the tip of screw 12, as illustrated in FIG. 3. Screw 12 connects seal button 5 with pressure member 25 of lever assembly 14.

Prior to installing body 1 with water line 2, bulb 23 is assembled with the lever arms 15 and 16 and screw 12 is threaded downwardly by insertion of a suitable tool into body 1. Threading down of screw 12 tends to pivot the lever arms in a direction to move the end sections 22 toward each other to increase the compressive stress on bulb 23. The tool is designed to only apply a given torque, sufficient to compress the Belleville spring washer 6, which in turn, applies a predetermined and constant compressive load through the lever mechanism to the bulb 23. After proper adjustment of the compressive force on bulb 23 by threading of screw 12, the sprinkler head can then be assembled with water line 2.

As best shown in FIG. 4, sections 20 and 21 of lever arms 15, 16 are notched, as indicated by 26, so that the lever arms can nest together in side-by-side relation and the holes 24 in end sections 22 are aligned with the axis of bulb 23. Thus, the compressive force applied through end sections 22 to the bulb 23 will be in direct alignment with the axis of the bulb.

The sprinkler head as shown in FIGS. 1-3, is mounted in a flush mode, in which the glass bulb 23 is located beneath and parallel to the ceiling 27 of the building. The bulb 23 is enclosed by a plastic protective cover or housing 28, shown in FIG. 6, having four uniformly spaced, flexible legs 29, each having a latch 30 cantilevered inward at the upper end, which snap into four corresponding notches 25*d* in the lower outside edge of the channel-shaped pressure member 25. In addition, an annular escutcheon plate 31 is mounted on the lower end of body I and bears against ceiling 27. Plate 31 covers the gap between the body 1 and the edge bordering the ceiling hole. Cover 28 is provided with a bottom hole 32 and four equal spaces between the legs 29 through which the hot air or combustion gases can pass to contact the bulb 23.

When the bulb 23 is exposed to a predetermined elevated temperature, the bulb will rupture and the lower ends 22 of lever arms 15 and 16 will pivot inwardly toward each other, thereby moving the upper ends 17 out of engagement with the shoulders 18 to release the cap assembly 4 and the channel-shaped pressure member 25 combined with cover 28. The cap assembly will then be forced downwardly by the pressure of the water in line 2 until the stops 10 on rods 8 engage the body 1 to thereby hold or retain the deflector 7 in a given position, so that the water will engage the deflector and be spread or deflected outwardly in the desired spray pattern.

FIGS. 7 and 8 show a modified form of the invention, in which the sprinkler head is mounted in a concealed mode. The sprinkler head of FIGS. 7–8 is identical to that shown in FIGS. 1–6 except that the bulb 23 is mounted above the ceiling 27 and pressure member 25 is a channel and does not include the notches 25*d*, as in the first embodiment.

In this embodiment, a solid decorative plate 33 is mounted against the lower surface of ceiling 27 and is supported by a generally cylindrical sleeve 34 that surrounds body 1. The lower end of sleeve 34 is provided with an outwardly extending flange 35 having a series of radial slits which accommodate thin rectangular copper tube sections that define tabs or feet 36. Each tab 36 is connected to decorative plate 33 by a layer of low melting point alloy or solder 37.

When the sprinkler head is subjected to a given elevated temperature, solder 37 will melt, releasing the decorative plate 33. The heated air or combustion gases will then contact the glass bulb 23 and at a predetermined temperature the bulb 23 will rupture to release the cap assembly 4 in the manner previously described.

The decorative plate 33 is biased upwardly into engagement with ceiling 27. In this regard, a ring 38 is connected to the lower end of body 1 by a wire clip 39 that is received in the space or gap between circumferentially spaced shoulders 40 on body 1 and outwardly extending diametrically opposed upwardly extending ledges 41 on ring 38. Coil spring 42 is interposed between ring 38 and the upper inwardly extending flanges 43 on sleeve 34. With this construction, the force of spring 42 urges sleeve 34 upwardly to bias plate 33 into tight engagement with ceiling 27. If, during service, the vertical spacing between body 1 and ceiling 27 should change, the biasing action of spring 42 will maintain the plate 33 in contact with the ceiling to prevent an unsightly gap between the plate and the ceiling. This biasing action of spring 42 also provides a high and low positioning tolerance for the installation of the sprinkler.

With the invention, the glass bulb is mounted parallel to the ceiling, or other supporting wall, or in other words the axis of bulb 23 is normal to the axis of outlet 3. This enables the bulb to be mounted in close proximity to the ceiling in a position where it is exposed to the highest temperature gas stream, thus providing the sprinkler head with a substantially faster response than conventional glass bulb sprinkler heads in which the bulb is mounted normal to the ceiling, or other supporting surface.

The sprinkler head is less costly than conventional flush mode types, in that it requires fewer moving parts and the lever arms 15 and 16 are of identical construction.

As a further advantage, the sprinkler head can be used in either a recessed or flush mount configuration, and this is a substantial advantage over prior sprinkler heads in which separate sprinkler heads were required for both flush and recessed mounting.

Various modes of carrying out the invention are contemplated as being within the scope of the following claims particularly pointing out and distinctly claiming the subject matter which is regarded as the invention.

I claim:

1. A sprinkler head, comprising a tubular body to be connected to a source of water and having an outlet end, closure means to close said outlet end, an elongated frangible bulb having a longitudinal axis disposed generally normal to a central axis of said outlet end, a pair of lever arms, a first end of each lever arm engaged with said body and second ends of said lever arms being spaced apart, said bulb being connected between said second ends, and adjusting means interconnecting said closure means with a central portion of each lever arm and adjustably mounted to translate relative to said closure means, said adjusting means comprising means for moving said second ends in a direction toward each other to apply compressive force to said bulb.

2. The sprinkler head of claim 1, wherein said lever arms are disposed in an X-configuration.

3. The sprinkler head of claim 1, and including an internal shoulder on said body, the first ends of said lever arms being engaged with said shoulder.

4. The sprinkler head of claim 1, and including resilient sealing means carried by said closure means and engaged with said body to seal said outlet end.

5. The sprinkler head of claim 1, and including deflector means connected to said closure means and movable between a retracted position and an extended position, release of said closure means effecting movement of said deflector means from said retracted position to said extended position, and retaining means for retaining said deflector means in said extended position when said closure means is released.

6. The sprinkler head of claim 5, wherein said retaining means comprises a plurality of guide rods connected to said deflector means and slidable relative to said body, and stop means associated with each guide rod for limiting the movement of said guide rods and said deflector means.

7. The sprinkler head of claim 1, wherein said bulb is disposed beneath a ceiling in a building, said sprinkler head also including a cover mounted beneath said ceiling and enclosing said bulb, and opening means in said cover for permitting the flow of gas through said cover.

8. The sprinkler head of claim 7, wherein said cover is cup-shaped and has a side wall and a bottom wall, said opening means comprising a first opening in said side wall and a second opening in said bottom wall.

9. The sprinkler head of claim 1, wherein said bulb is disposed above and parallel to a ceiling of a building, a tubular member secured to the body and disposed outwardly of said bulb, an enclosure member mounted against the lower surface of the ceiling and enclosing said bulb, and thermally responsive means connecting said tubular member and said enclosure member, exposure of said thermally responsive means to a predetermined elevated temperature releasing said thermally responsive means to thereby release said enclosure member and expose said bulb.

10. The sprinkler head of claim 9, and including biasing means for biasing said tubular member upwardly relative to said body to thereby urge said enclosure member against said ceiling.

11. The sprinkler head of claim 1, wherein said adjusting means includes a screw threaded to said closure means.

12. The sprinkler head of claim 11, and including a pressure member interconnecting the central portions of said lever arms, said screw engaged with said pressure member.

13. The sprinkler head of claim 12, wherein said pressure member comprises a channel including a web and a pair of spaced flanges extending outwardly from said web, said web being engaged with said central portions and said flanges straddling said lever arms.

14. A sprinkler head, comprising a tubular body to be connected to a source of water and having an outlet end, a closure to close said outlet end, a pair of identical lever arms disposed in side-by-side X-configuration, each lever arm having a first end engaged with said body and each lever arm including a first inclined section extending downwardly from said first end, each lever arm also including a horizontal section connected to said first inclined section and a second inclined section extending downwardly from said horizontal section, each lever arm also including a vertical end portion extending downwardly from a lower end of said second inclined section, said horizontal sections being disposed in side-by-side relation, a pressure member interconnecting said horizontal sections, an elongated frangible bulb connecting said vertical end portions of said lever arms, and an adjustable member interconnecting said closure and said pressure member, adjustment of said adjusting member acting to pivot said lever arms and move said vertical end portions in a direction toward each other to apply a compressive force on said bulb.

15. The sprinkler head of claim 14, wherein each vertical end portion is provided with a recess to receive an end of said bulb.

16. The sprinkler head of claim 15, wherein said recesses are in alignment with a longitudinal axis of said bulb.

17. The sprinkler head of claim 16, wherein each lever arm is provided with a notch to receive the other lever arm.

18. A sprinkler head, comprising a tubular body to be connected to a source of water and having an outlet end, a closure to close said outlet end, an elongated frangible bulb having a pair of ends and having a longitudinal axis disposed generally normal to a central axis of said outlet end, releasable means interconnecting the body and the bulb and having spaced portions disposed to engage the ends of the bulb, connecting means interconnecting the closure and said releasable means and constructed and arranged to maintain the closure in a closed position when the bulb is engaged with said spaced portions, fracture of said bulb when exposed to an elevated temperature causing release of said releasable means relative to said body to thereby release said closure, said releasable means comprising a pair of lever arms, one end of each lever arm being engaged with said body and the opposite ends of said lever arms comprising said spaced portions, said lever arms disposed in an X-configuration, said releasable means also including a pressure member connecting said lever arms, said connecting means interconnecting said pressure member and said closure.

19. The sprinkler head of claim 18, wherein said connecting means comprises a screw threaded to said closure and having an extremity engaged with said pressure member, threading of said screw in said closure acting to change the spacing between said opposite ends of said lever arms.

20. A sprinkler head, comprising a tubular body to be connected to a source of water and having an outlet end, a closure to close said outlet end, an elongated frangible bulb having a pair of ends and having a longitudinal axis disposed generally normal to a central axis of said outlet end, releasable means comprising lener arms interconnecting the body and the bulb and having spaced portions disposed to engage the ends of said bulb, and connecting means interconnecting the closure and said releasable means and constructed and arranged to maintain the closure in a closed position when the bulb is engaged with said spaced portions, fracture of said bulb when exposed to an elevated temperature causing release of said releasable means relative to said body to thereby release said closure, said lever arms being disposed in an X-configuration, one end of each lever arm being engaged with said body and the opposite ends of said lever arms comprising said spaced portions, said spaced portions being provided with recesses to receive the ends of said bulb, a side of each lever arm facing the other lever arm and having a notch to receive said other lever arm, said recesses being in alignment with the longitudinal axis of said bulb.

* * * * *

UNITED STATES PATENT AND TRADEMARK OFFICE

CERTIFICATE OF CORRECTION

PATENT NO. : 5,234,059

DATED : August 10, 1993

INVENTOR(S) : LAWRENCE R. EYNON

It is certified that error appears in the above-indentified patent and that said Letters Patent is hereby corrected as shown below:

Col. 8, Line 23, CLAIM 20, Cancel "lener" and substitue therefor --lever--

Signed and Sealed this

Twenty-third Day of August, 1994

*Attest:*

Bruce Lehman

BRUCE LEHMAN

*Attesting Officer*

*Commissioner of Patents and Trademarks*